US007001110B2

(12) United States Patent
Lockwood

(10) Patent No.: US 7,001,110 B2
(45) Date of Patent: Feb. 21, 2006

(54) PRECAST CONCRETE RETAINING WALL

(75) Inventor: William D. Lockwood, Dayton, OH (US)

(73) Assignee: Con/Span Bridge Systems Ltd., Dayton, OH (US)

( * ) Notice: Subject to any disclaimer, the term of this patent is extended or adjusted under 35 U.S.C. 154(b) by 0 days.

(21) Appl. No.: 10/790,491

(22) Filed: Mar. 1, 2004

(65) Prior Publication Data

US 2005/0191130 A1 Sep. 1, 2005

(51) Int. Cl.
*E02D 5/74* (2006.01)

(52) U.S. Cl. ..... 405/284; 52/295; 52/610

(58) Field of Classification Search ..... 405/124, 405/125, 134, 286; 52/295, 610, 745.21, 52/79.9

See application file for complete search history.

(56) References Cited

U.S. PATENT DOCUMENTS 2,420,228 A * 5/1947 Condon ..... 405/286
3,225,548 A * 12/1965 Hayden ..... 405/286
4,993,872 A 2/1991 Lockwood ..... 405/125
5,456,554 A * 10/1995 Barrett et al. ..... 405/284
5,536,113 A * 7/1996 McGregor ..... 405/125

OTHER PUBLICATIONS http://web.archive.org/web/20030203035234/http://pavingexpert.com/reinfrc1.htm, "Concrete Reinforcement", pp. 1-4.*

* cited by examiner

*Primary Examiner*—Thomas B. Will
*Assistant Examiner*—Tara L. Mayo
(74) *Attorney, Agent, or Firm*—Jacox, Meckstroth & Jenkins

(57) ABSTRACT

A precast concrete retaining wall forms a wing wall for a precast concrete culvert unit and is supported by a concrete footer with one or more precast anchor member projecting laterally from the wing wall into the back-filled soil behind the wing wall. Secondary reinforcing members in the form of elongated metal fibers or light weight welded wire mesh extend throughout the wing wall, and substantially heavier primary reinforcing bars extend vertically within the wing wall where head portions of reinforcing rods within the anchor member connect with the wing wall. In another embodiment, the reinforcing rods within the anchor member extend through ducts or tubes and have end portions threaded into the tubular anchors precast within the wing wall adjacent the reinforcing rods to provide for attaching the anchor member at the construction site after separately precasting the anchor member and wing wall.

9 Claims, 2 Drawing Sheets

PRECAST CONCRETE RETAINING WALL

BACKGROUND OF THE INVENTION

This invention relates to precast reinforced concrete soil retaining walls such as, for example, the wing walls disclosed in U.S. Pat. No. 4,993,872, the disclosure of which is incorporated herein by reference. As shown in this patent, a precast concrete soil retaining wing wall is attached to a precast concrete bridge or culvert unit having a head wall at the entrance of the culvert unit. Each wing wall is provided with a precast concrete anchor member which projects laterally from the wing wall into the back-filled soil behind the wing wall. The anchor member has reinforcing rods with L-shaped end portions which project into the concrete wing wall between the parallel spaced mats or grids of reinforcing rods. In the fabrication of each wing wall, the anchor members are precast with the L-shaped end portions of reinforcing rods projecting from the concrete, and the precast anchor members are then supported or suspended above the horizontal forms for the wing wall. Thus when the wing wall is cast, the L-shaped end portions of the reinforcing rods projecting from the anchor member are embedded within the wing wall between the parallel spaced grids of reinforcing rods as shown in the above patent.

It has been found highly desirable to simplify the fabrication of the wing walls and anchor members and to minimize the reinforcing steel in the wing walls without sacrificing the strength and performance of the wing walls and anchor members. A reduction in the reinforcing steel in a wing wall is also desirable in order to reduce the total weight of the wing walls for shipping and handling with a crane.

SUMMARY OF THE INVENTION

The present invention is directed to an improved precast concrete retaining wall which is ideally suited for use with precast concrete bridge or culvert units such as shown in the above-mentioned patent. As used herein, the term retaining wall includes a wing wall and an abutment wall which may be used to support a bridge section or panel. A precast concrete wing wall constructed in accordance with the invention includes at least one precast anchor member which is rigidly connected to the wing wall and projects laterally from the wing wall into the back-filled soil behind the wing wall. The wing wall and anchor member are constructed to minimalize the weight of steel reinforcement within the concrete and also to simplify the fabrication and assembly of the wing wall and anchor member.

In accordance with one embodiment of the invention, a concrete anchor member is precast with an outer inclined flange wall and a connecting vertical web wall which is reinforced by reinforcing rods having projecting end portions with enlarged heads. The wing wall is reinforced with primary reinforcing members in the form of vertical reinforcing rods located within the wing wall adjacent the vertical web wall of the anchor member and between the web wall and the head portions of the reinforcing rods in the web wall. The remaining portion of the wing wall is reinforced with a relatively lighter weight secondary reinforcement such as reinforcing steel fibers or light weight welded wire fabric or mesh. The size and height of the primary reinforcing members or vertical rods in the wing wall and the number of rods are selected according to the height of the wing wall in the area where the anchor member is connected and the resistance forces required from the anchor member.

In accordance with another embodiment of the invention, a wing wall is precast with embedded tubular anchors having internal threads and enlarged head portions, and the anchor member is precast separately with ducts or tubes so that the wing walls and anchor members may be handled and shipped separately. Also, a plurality of wing walls may be stacked and a plurality of anchor members may be nested during shipping, for example, on a flat-bed truck. When the wing walls and anchor members arrive at the site of culvert or bridge construction, elongated tie rods with threaded end portions are used to connect each precast anchor member to its corresponding precast wing wall. As mentioned above, the remaining portions of the wing wall and anchor member are reinforced with relatively lighter weight secondary reinforcement such as metal reinforcing fibers or welded wire fabric.

Other features and advantages of the invention will be apparent from the following description, the accompanying drawings and the appended claims.

DESCRIPTION OF THE PREFERRED EMBODIMENTS

Figure 1:
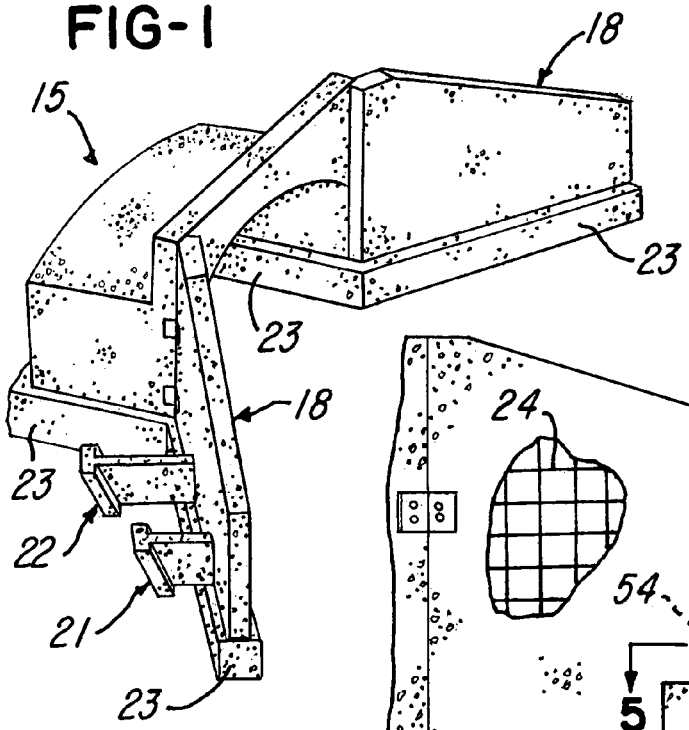
FIG. 1 is a perspective view of precast concrete end culvert unit connected to wing walls constructed in accordance with the invention.

FIG. 1 illustrates an end culvert unit 15 and a pair of soil retaining walls or wing walls 18 having an overall appearance similar to that shown in FIG. 12 of above-mentioned U.S. Pat. No. 4,993,872, but wherein each of the wing walls 18 is constructed in accordance with the present invention in order to simplify fabrication of the wing walls and to reduce the overall weight of the wing walls. As shown in FIG. 1, each of the wing walls 18 is rigidly connected to a set of anchor members 21 and 22 each having the general configuration of the anchor members disclosed in above-mentioned U.S. Pat. No. 4,993,872. The wing walls 18 are positioned on corresponding site cast reinforced concrete footers 23 which continue under the side walls of the culvert unit 15.

Figure 2:
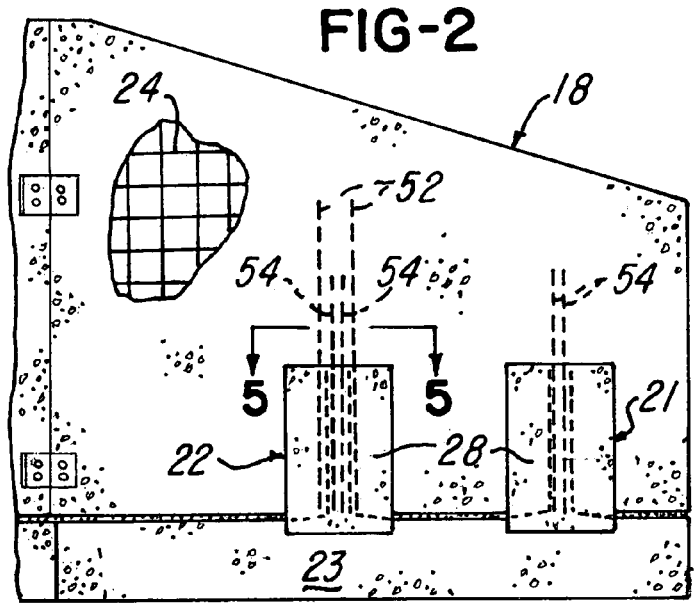
FIG. 2 is an elevational view of one of the wing walls shown in FIG. 1 and illustrating the use of the difference reinforcing members in accordance with the invention.
Figure 3:
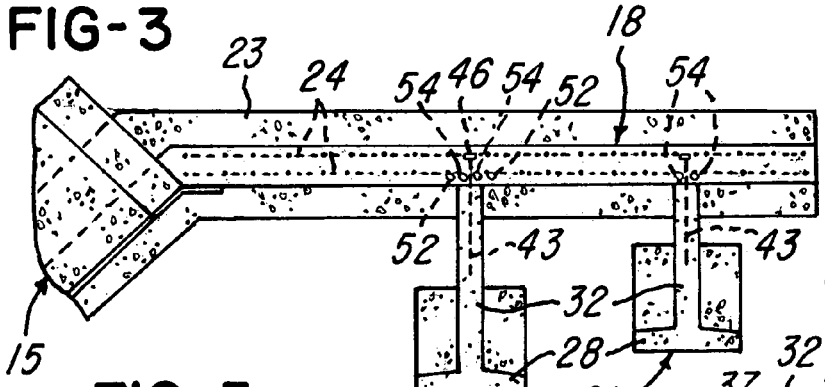
FIG. 3 is a top view of the wing wall and anchor member shown in FIG. 2 with the primary and secondary reinforcing members shown in dotted and dash form.
Figure 4:
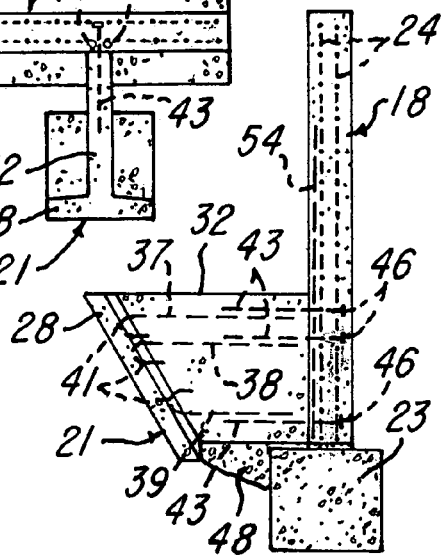
FIG. 4 is an end view of the wing wall and anchor member shown in FIG. 2 with the reinforcing members shown and dotted and dash form.
Figure 5:
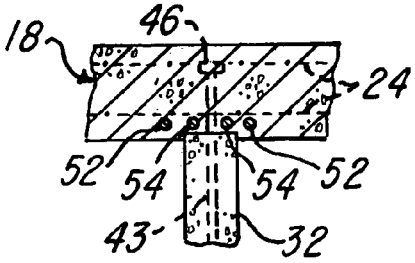
FIG. 5 is an enlarged fragmentary section taken generally on the line 5—5 of FIG. 2.

Referring to FIGS. 2–4, each of the wing walls 18 is provided with secondary reinforcing members such as parallel spaced light weight grids 24 of welded wire fabric or mesh, and the grids extend generally throughout the entire wing wall. The secondary reinforcing members may also be metal reinforcing fibers such as twisted metal fibers which are disbursed within the concrete generally throughout the wing wall. Each of the anchor members 21 and 22 includes an outer flange wall 28 which is inclined downwardly and inwardly, and the flange wall 28 is precast with a vertical web wall 32 integrally cast with the outer flange wall 28. The outer flange wall 28 of each anchor member is reinforced with secondary reinforcing members (not shown) such as a grid of welded wire mesh or steel fibers, and the web wall 32 of each anchor member is reinforced with vertically spaced primary reinforcing members in the form of steel rebars or rods 37, 38 and 39 each of which has a hook-shaped outer end portion 41 (FIG. 4).

Another set of primary reinforcing members or rods 43 are embedded within the web portion 32 of each anchor member, and the rods 43 have enlarged head portions 46 which project from the web wall 32 and into the concrete forming the wing wall 18. After each wing wall 18 and attached anchor members 21 and 22 are set in place on the corresponding footer 23, concrete 48 (FIG. 4) is poured onto each footer and flows between the bottom of each anchor member and the footer, as also disclosed in FIG. 15 of above-mentioned U.S. Pat. No. 4,993,872.

As shown in FIGS. 2–5, each of the wing walls 18 is provided with a plurality or set of primary reinforcing members or rods 52 and/or 54 which extend vertically within the wing wall 18 adjacent the inner end of the web wall 32 of each anchor member. The primary reinforcing members or rods 52 and 54 are substantially heavier than the secondary reinforcing members or grids 24 of welded wire fabric or mesh. Both pairs of primary reinforcing members or vertical rods 52 and 54 are positioned adjacent the web wall 32 of the anchor member 22, and only one pair of the reinforcing members or vertical rods 54 extend adjacent the web wall 32 of the shorter anchor member 21. The size, spacing and length of the primary reinforcing members or rods 52 and 54 are selected according to the resistance forces required by each wing wall from each anchor member. The light weight secondary reinforcing members 37–39 within each anchor member may also be replaced with reinforcing members in the form of metal fibers which are disbursed within the concrete forming the flange wall 28 and web wall 32 of each anchor member.

Figure 6:
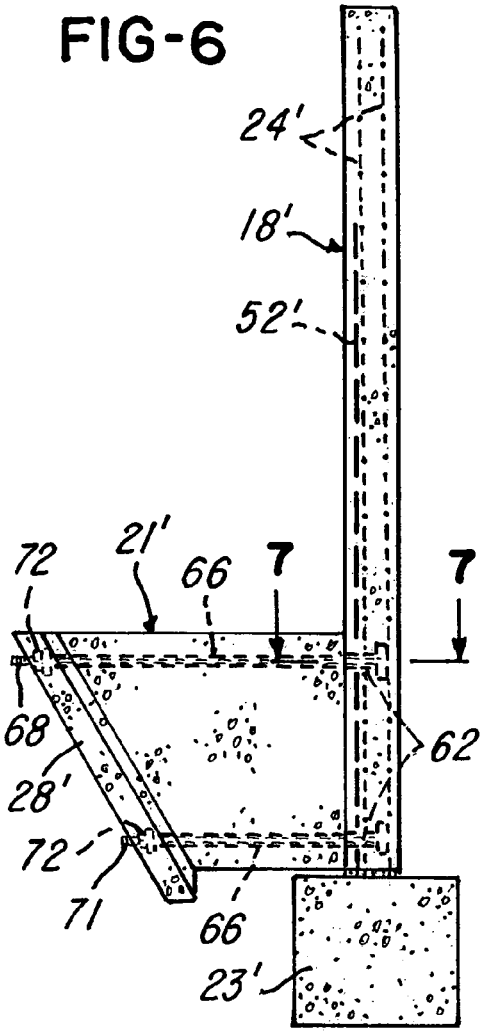
FIG. 6 is an end elevational view similar to FIG. 4 of a retaining wall or wing wall and anchor member constructed in accordance with a modification of the invention and with the internal reinforcement members shown in dotted and dash form.
Figure 7:
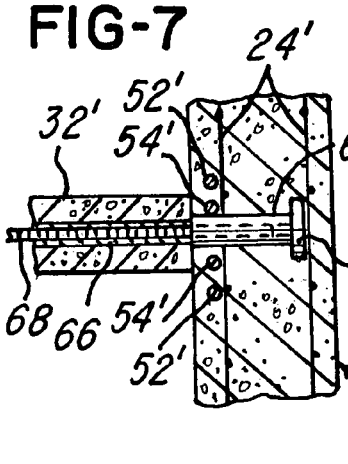
FIG. 7 is an enlarged fragmentary section taken generally on the line 7—7 of FIG. 6.

FIGS. 6–9 show modifications of retaining walls or wing walls constructed in accordance with the invention. A retaining wall or wing walls 18' is constructed substantially the same as the wing wall 18 described above and includes relatively light-weight secondary reinforcing members 24' and primary reinforcing members or rods 54' embedded in the wing wall adjacent the location for the web wall 32' of an anchor member 21'. The wing wall 18' is also supported by a site cast concrete footer 23'. In this embodiment, the wing wall 18' is precast with embedded vertically spaced tubular anchors 62 (FIG. 7), and the anchors 62 have internal threads and enlarged head portions 64. The concrete anchor member 21' is precast separately from the wing wall 18' and is provided with upper and lower ducts or tubes 66 which may be of metal or plastics material. After the wing wall 18' and anchor member 21' arrive at a construction site, elongated metal tie rods 68 and 71 are extended through the corresponding tubes 66, and the anchor member 21' is positioned so that the tie rods 68 and 71 are threaded into the corresponding tubular anchors 62 as shown in FIGS. 6 and 7. Nuts 72 are threaded onto the outer end portions of the tie rods and are located within pockets or cavities formed within the outer flange wall 28' of the anchor member 21'.

Figure 8:
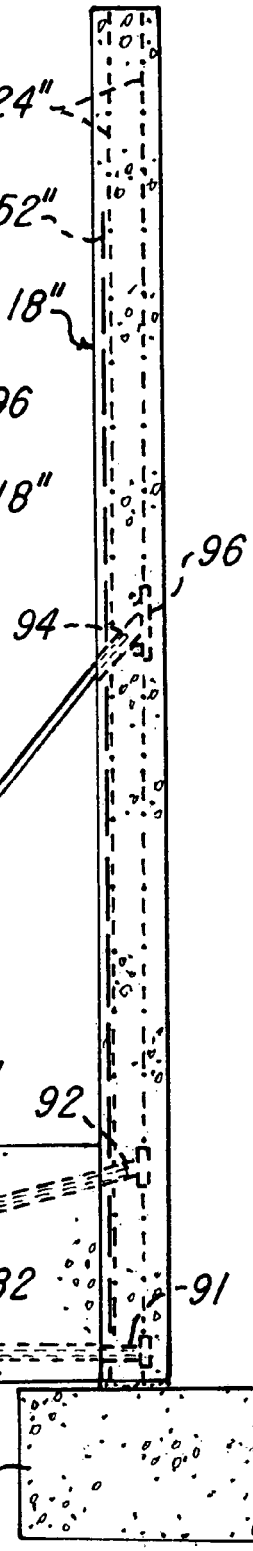
FIG. 8 is another embodiment of a retaining or wing wall and anchor member constructed and assembled in accordance with the invention.
Figure 9:
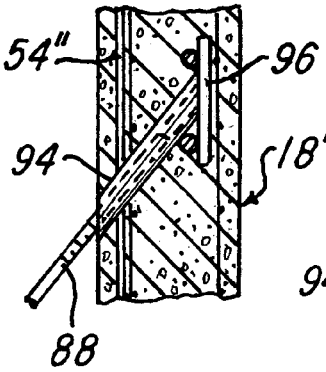
FIG. 9 is an enlarged fragmentary section of a portion of the wing wall shown in FIG. 8.

Another modification of a retaining wall or wing wall assembly is shown in FIGS. 8 and 9. In this embodiment, a retaining wall or wing wall 18" has a substantial height, greater than the height of either the wing wall 18 or 18'. A precast anchor member 22" has the same general configuration as the anchor member 22 described above but is cast with three internal ducts or tubes 82, 83 and 84 in the web wall 32". The tubes receive corresponding tie rods 86, 87 and 88 each of which has opposite threaded end portions. The inner end portions of the tie rods 86 and 87 are threaded into the corresponding tubular anchors 91 and 92 embedded in the retaining wall 18" and having enlarged head portions in the same manner as the tubular anchors 62. The tie rod 88 extends on an incline and externally of the anchor member 22" and has an upper end portion threaded into an inclined tubular anchor 94 having an enlarged head portion 96, as shown in FIG. 9. The lower threaded end portion of the tie rod 88 and the outer end portions of the tie rods 86 and 87 receive corresponding nuts 72 which are located within corresponding recesses or cavities within the outer flange wall 28" of the anchor member 22".

From the drawings and the above description, it is apparent that an assembly of a precast retaining wall or wing wall and a precast anchor member constructed in accordance with the invention, provides desirable features and advantages. For example, by locating the relatively heavy primary reinforcing members or vertical rods 52 and/or 54 in the retaining wall or wing wall in the area where an anchor member is connected, and extending the primary reinforcing rods upwardly above the anchor member, the remaining portion of the retaining or wing wall may be reinforced with secondary reinforcing members which are substantially lighter in weight such as the welded wire mesh or metal fibers. The secondary reinforcing members provide sufficient strength to resist the back-fill loading on the retaining or wing wall and sufficient strength to resist shrinkage of the concrete and expansion and contraction due to temperature changes. As a result, the fabrication of the wing walls is significantly simplified and the total weight of reinforcing steel within the wing wall is significantly reduced, thereby significantly reducing the total weight of the wing wall.

As mentioned above, the size of the primary reinforcing rods or bars, the length of the bars and the spacing between adjacent bars is selected to accommodate the resistance forces produced by the anchor members on the wing walls. By significantly reducing the total weight of the wing walls and anchor members, the cost of shipping the precast assemblies is significantly reduced, and the handling of the assemblies at the construction site is simplified since a lower capacity crane is required to handle the assemblies. The enlarged head portions 46 on the reinforcing members or rebars or rods 43 within the anchor member with the head portions located outwardly of the primary reinforcing members 52 and 54, also simplifies the precasting of the wing walls with the integrally attached anchor members and provide for transferring higher forces between the anchor members and the wing walls.

Additional features are provided by the attachable anchor members as disclosed in connection with FIGS. 6–9. That is, by precasting the anchor members 21' and 22" separately from the precasting of the wing walls 18' and 18", a series of wing walls may be stacked for purposes of storage and transportation to a construction site, and the anchor members may be nested for storage and transporting to the construction site where the anchor members are assembled to the wing walls with the threaded tie rods as shown in FIGS. 6–9. For higher wall panels, the external tie rod 88 is desirable for connecting the anchor member to an upper portion of the retaining or wing wall.

While the forms of retaining wall and anchor members and their methods of assembly herein described constitute preferred embodiments of the invention, it is to be understood that the invention is not limited to these precise forms and methods, and that changes may be made therein without departing from the scope and spirit of the invention as defined in the appended claims.

What is claimed is:

1. A precast concrete retaining wall system adapted for use as a wing wall for a concrete culvert to retain a backfill of soil, comprising a precast concrete vertical retaining wall adapted to be supported by a concrete footer, at least one precast concrete anchor member including an outer flange wall and an integrally connected web wall connecting said flange wall to said retaining wall, elongated reinforcing members extending within said web wall of said anchor member and including connecting portions projecting into and embedded within said concrete retaining wall, a set of generally vertical primary reinforcing bars extending only within a portion of said retaining wall adjacent opposite sides of said reinforcing members within said web wall of said anchor member and projecting above said anchor member between said web wall and said connecting portions of said reinforcing members, secondary reinforcing members extending generally throughout said retaining wall, and said secondary reinforcing members being substantially lighter and smaller than said primary reinforcing bars, for substantially reducing the total weight of said secondary reinforcing members within said retaining wall and thereby substantially reduce the total weight of said retaining wall system.

2. A wall system as defined in claim 1 wherein said connecting portions of said reinforcing members within said web wall of said anchor member comprise enlarged head portions embedded within said concrete of said retaining wall, and said primary reinforcing bars are located between said head portions and said web wall of said anchor member.

3. A wall system as defined in claim 1 wherein said web wall of said anchor member extends generally parallel to said vertical primary reinforcing bars within said retaining wall.

4. A wall system as defined in claim 1 wherein said connecting portions of said reinforcing members within said web wall of said anchor member comprise internally threaded tubular anchors embedded within said retaining wall, and said reinforcing members within said web wall of said anchor member comprise tie rods rotatably supported within guide tubes within said web wall and having threaded end portions connected to said tubular anchors within said retaining wall.

5. A wall system as defined in claim 4 wherein said tie rods have threaded outer end portions projecting from said web wall of said anchor member, and nut members threaded onto said outer end portions of said tie rods.

6. A wall system as defined in claim 5 wherein at least one said threaded tubular anchor is embedded within said retaining wall on an incline relative to said retaining wall and above said precast anchor member, and one of said tie rods is inclined relative to said retaining wall and has a threaded upper end portion threaded into said one tubular anchor.

7. A wall system as defined in claim 1 wherein said secondary reinforcing members extending generally throughout said retaining wall comprise elongated metal reinforcing fibers.

8. A wall system as defined in claim 1 wherein said secondary reinforcing members extending generally throughout said retaining wall comprise a mesh of reinforcing wires substantially lighter and smaller than said primary reinforcing bars.

9. A precast concrete retaining wall system adapted for use as a wing wall for a concrete culvert to retain a backfill of soil, comprising a precast concrete vertical retaining wall adapted to be supported by a concrete footer, a plurality of horizontally spaced precast concrete anchor members each including an outer flange wall and an integrally connected web wall connecting said flange wall to said retaining wall, elongated reinforcing members extending within said web wall of each said anchor member and including connecting portions projecting into and embedded within said concrete retaining wall, a set of generally vertical primary reinforcing bars extending only within a portion of said retaining wall adjacent opposite sides of said reinforcing members within said web wall of each said anchor member and projecting above the corresponding said anchor member between said web wall and said connecting portions of the corresponding said reinforcing members, secondary reinforcing members extending generally throughout said retaining wall, and said secondary reinforcing members being substantially lighter and smaller than said primary reinforcing bars, for substantially reducing the total weight of said secondary reinforcing members within said retaining wall and thereby substantially reduce the total weight of said retaining wall system.

* * * * *